US005825000A

United States Patent [19]

Jun

[11] Patent Number: 5,825,000

[45] Date of Patent: Oct. 20, 1998

[54] WAVE GUIDE SYSTEM OF A MICROWAVE OVEN

[75] Inventor: Woo-Keum Jun, Incheon, Rep. of Korea

[73] Assignee: Daewoo Electronics Co., Ltd., Rep. of Korea

[21] Appl. No.: 921,244

[22] Filed: Aug. 29, 1997

[30] Foreign Application Priority Data

Aug. 31, 1996 [KR] Rep. of Korea ..... 96-37694

[51] Int. Cl.[6] ..... H05B 6/70

[52] U.S. Cl. ..... 219/746; 219/697; 219/748

[58] Field of Search ..... 219/746, 748, 219/747, 750, 751, 695, 696, 697, 756

[56] References Cited

U.S. PATENT DOCUMENTS

| | | | |
|---|---|---|---|
| 2,909,635 | 10/1959 | Haagensen | 219/746 |
| 4,371,769 | 2/1983 | Yoshimura et al. | 219/746 |
| 5,237,139 | 8/1993 | Berg et al. | 219/746 |
| 5,352,873 | 10/1994 | Carlsson et al. | 219/746 |
| 5,567,339 | 10/1996 | Joo et al. | 219/746 |

FOREIGN PATENT DOCUMENTS

| | | | |
|---|---|---|---|
| 53-24645 | 3/1978 | Japan | 219/746 |

*Primary Examiner*—Philip H. Leung

*Attorney, Agent, or Firm*—Cushman Darby & Cushman Intellectual Property Group of Pillsbury Madison & Sutro, LLP

[57] ABSTRACT

Disclosed is a wave guide system of a microwave oven which has a partition wall for separating a cavity in which food to be cooked is placed from a control room in which a magnetron for generating microwaves is provided, the partition wall having a first and second microwave feed openings for feeding the microwaves to the food; and a wave guide provided to the partition wall where the first and second microwave feed openings are formed, the wave guide having a horizontal upper wall, a side wall to which the magnetron is attached, and a lower wall having a first inclined portion connected to the side wall, a second inclined portion connected to the partition wall, and a vertical portion provided between the first and the second inclined portion.

8 Claims, 2 Drawing Sheets

WAVE GUIDE SYSTEM OF A MICROWAVE OVEN

BACKGROUND OF THE INVENTION

1. Field of the Invention

The present invention relates to a microwave oven, and more particularly to a wave guide system having a first and second microwave feed openings, which guide microwaves generated by a magnetron into food in a cavity of the microwave oven with a different phase and a different incident angle so as to uniformly heat the food placed in the cavity.

2. Description of the Prior Art

Generally, a microwave oven is an appliance for heating food by microwaves generated by a magnetron as a high-voltage current is applied thereto. In the microwave oven, the magnetron generates approximately 2,450 MHz microwaves. When the high-frequency microwaves are incident on the food placed in a cavity, particles of the food rapidly move so that a frictional heat is generated due to a friction between the particles. The microwave oven heats the food by using the frictional heat.

A microwave oven consists of a cavity and a control room. The cavity includes a tray on which a food is heated, a heater or stirrer fan located on an upper surface of the cavity, and an intake port and an exhaust port located on a side wall of the cavity. The control room includes a high-voltage transformer, a high-voltage condenser, a high-voltage diode, a magnetron and an antenna that are necessary parts for generating the microwaves which are incident on the food, and includes a cooling fan for cooling said parts and wave guide for guiding the microwaves.

First and second induction coils of the high-voltage transformer apply to the magnetron a high-voltage current which is necessary to generate microwaves. The magnetron generates high frequency microwaves and the high frequency microwaves are feed into a wave guide provided to a partition wall of the cavity. Then, the high frequency microwaves are incident on the food through the opening provided in the partition wall so as to heat the food.

The microwaves which are incident on the food through the opening of the partition wall are fed into the cavity with a predetermined phase and an incident angle. Because the microwaves with the predetermined phase and incident angle heat only a part of the food exposed to the microwaves, it is necessary to diffract the microwaves in order to uniformly heat the food placed in the cavity.

In order to solve the above-mentioned problem, the tray on which the food is heated is made to rotate in connection with a tray motor placed under the surface of the cavity. But even though the tray is made to rotate, a portion of the food is heated directly by the microwaves and a portion of the food is heated indirectly by the microwaves. In addition, the microwaves do not penetrate into the inside food.

Therefore, in order to better solve the problem, the microwaves are diffracted by using a stirrer fan or by providing two feed openings. By using a rotating stirrer fan, the microwaves generated by the magnetron are made to be incident on the food at various incident angles. But in a microwave oven using the stirrer fan, a production cost is high because a manufacture of the stirrer fan is complex.

In the method of providing two feed openings, a wave guide having two feed openings, a typical example of which is disclosed in U.S. Pat. No. 5,567,339, is used.

As shown in FIG. 1, a microwave oven comprises a cavity 110 containing a food 190 to be heated thereon and a control room 120 having parts for generating the microwaves and controlling the microwave oven. An upper feed opening 132 and a lower feed opening 134 at a partition wall 130 that divides the cavity 110 from the control room 120, a magnetron 140 having the antenna 145 and generating microwaves, and a wave guide 150 covering the upper feed opening 132 and the lower feed opening 134 and placed on the partition wall 130, are provided. A horizontal upper wall is formed parallel with the antenna 145 and is formed at a distance of $\lambda_g/4$ from the antenna 145.

The upper feed opening 132 is provided at an upper side of the partition wall 145 and the lower feed opening 134 is provided at a middle side of the partition wall 145. For making the microwaves with a uniform electromagnetic field, a distance between the upper feed opening 132 and the antenna 145 is formed to be smaller than a distance between the lower feed opening 134 and the antenna 145, and a size of the upper feed opening 132 is formed to be smaller than the lower feed opening 134. A part of the microwaves generated by the magnetron 140 is indirectly incident on the food 190 on the tray 180 in the cavity 110 through the upper feed opening 132, and the other part of the microwaves generated by the magnetron 140 is directly incident on the food 190 on the tray 180 in the cavity 110 through the lower feed opening 134. That is, the microwaves generated by the magentron 140 are incident on the food 190 through different paths. At the same time, the tray 180 is rotated by a motor 170 below the tray 180 so that the microwaves more uniformly heat the food 190.

In the microwave oven, the microwaves passing through the upper feed opening 132 and the lower feed opening 134 form an interference field in the cavity 110 so as to more uniformly heat the food 190. But an intensity of the microwaves deteriorates because the microwaves passing through the upper feed opening 132 are indirectly incident on the food 190. In addition, a size of the upper feed opening 132 and the lower feed opening 134 is dependent on the distance between the upper feed opening 132 and the antenna 145 and on the distance between the lower feed opening 134 and the antenna 145 so that a production process is complex.

SUMMARY OF THE INVENTION

Therefore, the present invention is provided for solving the above-mentioned problems. It is an object of the present invention to provide a wave guide system of a microwave oven which provides improved heating performance to allow a food in a cavity of the oven to be heated more uniformly and provides a shortened wave guide to permit easy arrangement of the parts of an electric apparatus for the microwave oven.

To achieve the above object of the present invention, there is provided a wave guide system of a microwave oven comprising: a partition wall for separating a cavity in which food to be cooked is placed from a control room in which a magnetron for generating microwaves is provided, the partition wall having a first and second microwave feed openings for feeding the microwaves to the food; and a wave guide provided to the partition wall where the first and second microwave feed opening are formed, the wave guide having a horizontal upper wall, a side wall to which the magnetron is attached, and a lower wall having a first inclined portion connected to the side wall, a second inclined portion connected to the partition wall, and a vertical portion provided between the first inclined portion and the second inclined portion.

According to the present invention, the wave guide is provided to the partition wall where the first and second microwave feed opening are formed so that paths of the microwaves become different after passing through the first and second microwave feed openings. And the wave guide is provided to the lower wall to which the first and second inclined portions are formed so that phases of the microwaves become different after being incident on the first and second inclined portions. Therefore, an interference of an electromagnetic field in the cavity is formed and more uniform heating of the food can be achieved by the interference. In addition, a variation in the distance between the partition wall and the vertical portion and the distance between the partition wall and the side wall produce a phase variation of the microwaves so that a size of the first and the second microwave feed openings can be identical with each other. Therefore, a production process is simple and a production cost is low.

Because the first and second microwave feed openings are formed below the antenna of the magnetron, all of the microwaves passing through the first and second microwave feed openings are directly incident on the food so that an intensity of the microwaves is ameliorated. Therefore, a heating efficiency is high, so a waste of the electrical power can be prevented.

BRIEF DESCRIPTION OF THE DRAWINGS

The above and other objects, features and advantages of the present invention will become more apparent from reading the following detailed description of the invention taken in connection with the accompanying drawing, wherein.

DESCRIPTION OF THE PREFERRED EMBODIMENT

A wave guide system of the microwave oven according to one preferred embodiment of the present invention will be described in detail with reference to the accompanying drawings.

Figure 1:
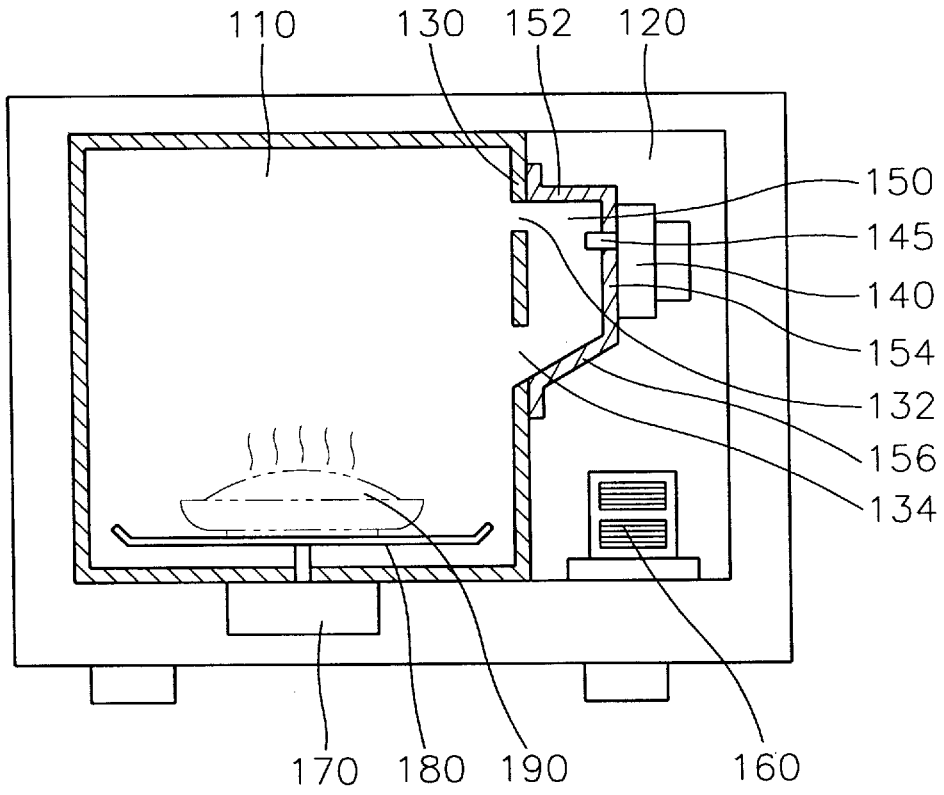
FIG. 1 (PRIOR ART)
FIG. 1 is a vertical sectional view illustrating a prior art wave guide system of the microwave oven.
Figure 2:
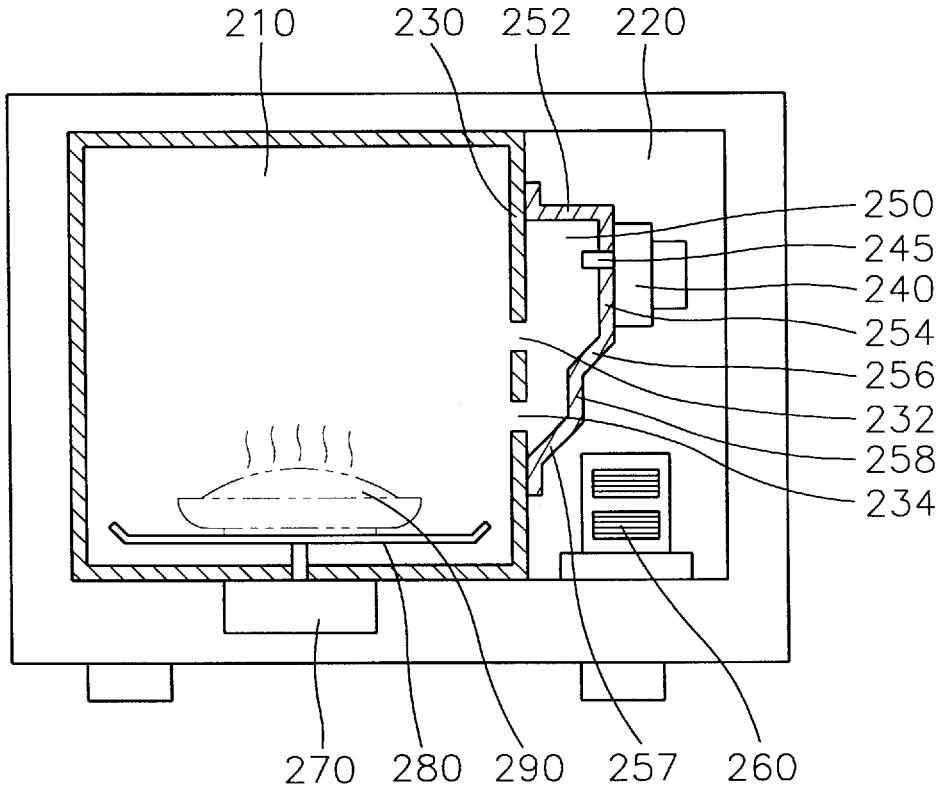
FIG. 2 is a vertical sectional view illustrating a wave guide system of the microwave oven according to one preferred embodiment of the present invention.

FIG. 2 is a vertical sectional view illustrating a wave guide system 250 of the microwave oven according to an embodiment of the present invention.

Referring to FIG. 2, the wave guide system 250 which guides microwaves generated by a magnetron 240 into food 290 in a cavity 210 comprises a horizontal upper wall 252, a side wall 254, a first inclined portion 256, a second inclined portion 257, and a vertical portion 258. The food 290 in the cavity 210 is placed on the tray 280 which is rotated by driving of a motor 270. When the microwaves are incident on the food 290, the tray 280 is rotated by driving of the motor 270 so that the food 290 on the tray 280 is more uniformly heated.

At a partition wall 230 for separating the cavity 210 in which the food 290 to be heated is placed from a control room 220 in which a magnetron 240 for generating microwaves is provided, a first microwave feed opening 232 and a second microwave feed opening 234 for feeding the microwaves to the food are formed. After each end of the horizontal upper wall 252 and the second inclined portion 257 of the wave guide system 250 is bent, the horizontal upper wall 252 and the second inclined portion 257 of the wave guide system 250 are attached on a portion where the first microwave feed opening 232 and the second microwave feed opening 234 of the partition wall 230 are formed. The magnetron 240 is attached to the side wall 254. The horizontal upper wall 252, the side wall 254, the first inclined portion 256, the vertical portion 258, and the second inclined portion 257 are continuously positioned adjacent to one another.

It is preferred that a distance L between the horizontal upper wall and a center of an antenna 245 of the magnetron 240 is $\lambda_g/4$.

The side wall 254 is formed to be parallel with the partition wall 230. The side wall 254 is formed to be perpendicular with the horizontal upper wall 252. The magnetron 240 is formed at a backside of the side wall 254 and an end of the antenna 245 of the magnetron 240 is formed between the side wall 254 and the partition wall 230. When the first inclined portion 256 is formed at a lower side of the side wall 254, a central line of the first microwave feed opening 232 is positioned to horizontally coincide with the border line of the side wall 254 and the first inclined portion 256. When the second inclined portion 257 is formed at a lower side of the vertical portion 258, a central line of the second microwave feed opening 234 horizontally coincides with the border line of the vertical portion 258 and the second inclined portion 256.

It is preferred that a size and a shape of the first microwave feed opening 232 and the second microwave feed opening 234 are the same. It is preferred that a shape of the first microwave feed opening 232 and the second microwave feed opening 234 is rectangular, but a shape of the first microwave feed opening 232 and the second microwave feed opening 234 can be circular and polygonal. In addition, when a wavelength of the microwaves generated by the magnetron 240 is $\lambda_g$, a distance l between a center of the first microwave feed opening 232 and a center of the second microwave feed opening 234 is $n\lambda_g/2$ (n is an integer) for preventing the cancellation of the microwaves.

A distance h between the vertical portion 258 and the partition wall 230 of the cavity 210 on which the first microwave feed opening 232 and the second microwave feed opening 234 are formed is larger than one-third of a distance H between the side wall 254 and the partition wall 230 of the cavity 210 and is smaller than a distance H between the side wall 254 and the partition wall 230 of the cavity 210 (that is, $H/3<h<H$). If a distance h between the vertical portion 258 and the partition wall 230 of the cavity 210 is larger than a distance H between the side wall 254 and the partition wall 230 of the cavity 210, it is difficult to set up the wave guide system 250 on the partition wall 230 because of the size of the parts positioned near the wave guide system 250, particularly because of the size of a high-voltage transformer 260 which is set up below the magnetron 240 and to which is applied a high-voltage current. Also, if a distance h between the vertical portion 258 and the partition wall 230 of the cavity 210 is smaller than one-third of a distance H between the side wall 254 and the partition wall 230 of the cavity 210, there is sufficient space to set up the wave guide system 250 and other parts in the control room 220. However, the path width of the microwaves is narrow because of a property of the wave guide system 250 and the microwaves. Therefore, a transmission efficiency becomes low (that is, an attenuation rate becomes high) so that a sufficient amount of the microwaves can not pass through the second microwave feed opening.

In the above-mentioned microwave oven, when a user turns on an operating switch (not shown), the high-voltage transformer 260 in the control room 220 generates a high-voltage current. The high-voltage current is applied to the magnetron 240 and the magnetron 240 generates the microwaves. The microwaves are fed into the wave guide system 250 through the antenna 245. After a part of the microwaves reflects off the first inclined portion 256, the part of the microwaves is incident on the food 290 in the cavity 210 through the first microwave feed opening 232 and heats the food 290 on the tray 280. After the other part of the microwaves reflects off the first inclined portion 256 positioned through an interval between the partition wall 230 and the vertical portion 258, the other part of the microwaves is incident on the food 290 in the cavity 210 through the second microwave feed opening 234 and heats the food 290 on the tray 280. The other part of the microwaves pass through an interval between the side wall 254 and the partition wall 230 of the cavity 210 which is formed to be larger than one-third of a distance H between the side wall 254 and the partition wall 230 of the cavity 210 and is formed to be smaller than a distance H between the side wall 254 and the partition wall 230 of the cavity 210. Therefore the other part of the microwaves passing through the second microwave feed opening 234 has a different phase from the part of the microwaves passing through the first microwave feed opening 232 because of a different incident angle and a different path from those of the one part of the microwaves. Therefore, an interference of an electromagnetic field in the cavity 210 is formed and more uniform heating of the food 290 can be achieved by the wave-interference.

Further, in the wave guide system of the microwave oven according the present invention, a variation in the distance between the partition wall and the vertical portion and the distance between the partition wall and the side wall produce a phase variation of the microwaves so that a size and shape of the first and the second microwave feed openings can be identical with each other. Therefore, a production process is simple and a production cost is low.

While the present invention has been particularly shown and described with reference to particular embodiments thereof, it will be understood by those skilled in the art that various changes in form and detail may be effected therein without departing from the spirit and scope of the invention as defined by the appended claims.

What is claimed is:

1. A microwave oven comprising:

a cavity in which food to be heated is placed;

a control room in which a magnetron for generating microwaves is provided;

a partition wall for separating the cavity from the control room, said partition wall having first and second microwave feed openings for feeding the microwaves to the food, wherein the first and second microwave feed openings interfere with the microwaves; and a wave guide provided in the control room and attached to the partition wall where the first and second microwave feed openings are formed, said wave guide having a horizontal upper wall, a side wall to which the magnetron is attached, and a lower wall having a first inclined portion connected to the side wall, for reflecting a first part of the microwaves, a second inclined portion connected to the partition wall, for reflecting a second part of the microwaves, and a vertical portion provided between the first and the second inclined portions, wherein a central line of the first microwave feed opening horizontally coincides with the border line of the side wall and the first inclined portion, and a central line of the second microwave feed opening horizontally coincides with the border line of the vertical portion and the second inclined portion, and an interference of the first and second parts of the microwaves is occurs in the cavity.

2. A microwave oven as claimed in claim 1, wherein the vertical portion and the side wall are parallel with said partition wall.

3. A microwave oven as claimed in claim 1, wherein a distance l between the central line of the first microwave feed opening and the central line of the second microwave feed opening is determined by the following relationship:

$$l = \frac{\lambda_g}{2} \times n$$

where n is an integer and $\lambda_g$ is a wavelength of the microwaves generated by the magnetron.

4. A microwave oven as claimed in claim 1, wherein a distance h between the vertical portion and the partition wall is determined by the following relationship:

$$\frac{H}{3} < h < H$$

where H is a distance between the side wall and the partition wall.

5. A microwave oven as claimed in claim 1, wherein a size and a shape of the first microwave feed opening and the second microwave feed opening are identical with each other.

6. A microwave oven comprising:

a cavity in which food to be heated is placed;

a control room in which a magnetron for generating microwaves is provided;

a partition wall for separating the cavity from the control room, said partition wall having first and second microwave feed openings for feeding the microwaves to the food;

a wave guide provided to the partition wall where the first and second microwave feed openings are formed, said wave guide having a horizontal upper wall, a side wall to which the magnetron is attached, and a lower wall having a first inclined portion connected to the side wall, for reflecting a first part of the microwaves, a second inclined portion connected to the partition wall, for reflecting a second part of the microwaves, and a vertical portion provided between the first and the second inclined portions, whereby an interference of the first and second parts of the microwaves occurs in the cavity;

a distance l between the central line of the first microwave feed opening and the central line of the second microwave feed opening is determined by the following relationship:

$$l = \frac{\lambda_g}{2} \times n$$

where n is an integer and $\lambda_g$ is a wavelength of the microwaves generated by the magnetron; and a distance h between the vertical portion and the partition wall is determined by the following relationship:

$$\frac{H}{3} < h < H$$

where H is a distance between the side wall and the partition wall.

7. A microwave oven as claimed in claim 6, wherein a central line of the first microwave feed opening horizontally coincides with the border line of the side wall and the first inclined portion, and a central line of the second microwave feed opening horizontally coincides with the border line of the vertical portion and the second inclined portion.

8. A microwave oven as claimed in claim 6, wherein a size and a shape of the first microwave feed opening and the second microwave feed opening are identical with each other.

* * * * *